US010792689B2

(12) United States Patent
Seid et al.

(10) Patent No.: US 10,792,689 B2
(45) Date of Patent: Oct. 6, 2020

(54) COMBINED SPRAY AND VACUUM NOZZLE

(71) Applicant: Nylok LLC, Macomb, MI (US)

(72) Inventors: Nicholas Seid, Hermosa Beach, CA (US); Eugene Sessa, Harrison Township, MI (US)

(73) Assignee: Nylok LLC, Macomb, MI (US)

( * ) Notice: Subject to any disclaimer, the term of this patent is extended or adjusted under 35 U.S.C. 154(b) by 20 days.

(21) Appl. No.: 14/490,054

(22) Filed: Sep. 18, 2014

(65) Prior Publication Data

US 2016/0082463 A1 Mar. 24, 2016

(51) Int. Cl.

| | |
|---|---|
| ***B05B 14/10*** | (2018.01) |
| ***B05B 7/14*** | (2006.01) |
| ***B05B 12/18*** | (2018.01) |
| ***B05B 13/06*** | (2006.01) |

(52) U.S. Cl.

CPC ..... *B05B 14/10* (2018.02); *B05B 7/1486* (2013.01); *B05B 12/18* (2018.02); *B05B 13/069* (2013.01)

(58) Field of Classification Search

CPC ..... B05B 15/0412; B05B 15/0431; B05B 7/1486; B05B 12/18; B05B 13/069; B05B 14/10; B24C 9/003; B24C 3/02; B24C 3/06; B24C 9/006

USPC ..... 239/120

See application file for complete search history.

(56) References Cited

U.S. PATENT DOCUMENTS 847,269 A * 3/1907 Wise ..... B24C 7/0046 451/101
3,452,714 A 7/1969 Durke et al.
3,858,262 A 1/1975 Duffy
4,035,859 A 7/1977 Newnom
4,060,868 A 12/1977 Axvig et al.

(Continued)

FOREIGN PATENT DOCUMENTS

EP 0093083 A2 * 11/1983 ..... B05B 15/0412
EP 0864686 A1 * 9/1998 ..... A41D 27/06

(Continued)

OTHER PUBLICATIONS

Nylok Aerospace Brochure, Self-locking, Nylok, retrieved from http://www.nylok.com/downloads/aerospace/Nylok_Aerospace_Brochure_LR.pdf, 2013.

(Continued)

*Primary Examiner* — Arthur O. Hall
*Assistant Examiner* — Steven M Cernoch
(74) *Attorney, Agent, or Firm* — Levenfeld Pearlstein, LLC

(57) ABSTRACT

A combined spray and vacuum nozzle includes a nozzle housing containing a powder supply passage and a vacuum withdrawal passage, where the powder supply passage and the vacuum withdrawal passage are arranged in a side-by-side relationship. The nozzle housing has a proximal end portion and a distal end portion. The distal end portion features a spray port in communication with the powder supply passage and a vacuum port in communication with the vacuum withdrawal passage. The spray port is positioned adjacent to the vacuum port. The proximal end portion of the nozzle housing adapted to communicate with a source of aspirated powder and a vacuum source so that the powder supply passage communicates with the source of aspirated powder and the vacuum withdrawal passage communicates with the vacuum source.

12 Claims, 5 Drawing Sheets

(56) References Cited

U.S. PATENT DOCUMENTS 4,100,882 A 7/1978 Duffy et al.
4,637,339 A * 1/1987 Walser ..... B05B 5/12 118/622
4,656,051 A 4/1987 Wojcik
4,661,379 A * 4/1987 Frei ..... B05B 5/032 427/181
5,033,925 A 7/1991 Mghe
5,080,547 A 1/1992 Moghe
5,090,355 A 2/1992 DiMaio et al.
5,138,972 A * 8/1992 Glanzmann ..... B05B 5/032 118/308
5,221,170 A * 6/1993 Duffy ..... B05B 13/06 411/387.1
5,474,609 A * 12/1995 Mulder ..... B05B 5/032 118/308
5,571,323 A * 11/1996 Duffy ..... B05B 7/1404 118/308
5,620,520 A 4/1997 Duffy et al.
5,620,741 A 4/1997 Duffy et al.
5,718,945 A 2/1998 Arslanouk
5,792,512 A 8/1998 Duffy et al.
5,795,626 A * 8/1998 Gabel ..... B05B 5/047 118/621
6,193,589 B1 * 2/2001 Khalaj ..... B24C 3/065 451/102
6,296,573 B1 * 10/2001 Duffy ..... F16B 39/34 470/18
6,322,628 B1 11/2001 Wallace
6,454,504 B2 9/2002 Duffy et al.
6,554,903 B1 * 4/2003 Sessa ..... B05B 15/0412 118/306
6,797,320 B2 9/2004 Sessa
7,182,671 B1 * 2/2007 Shimizu ..... B24C 3/065 451/38
7,211,147 B2 * 5/2007 Duffy ..... F16B 33/008 118/308
8,360,827 B1 * 1/2013 Coughtry ..... E01C 23/0855 451/102
8,434,982 B2 5/2013 Henriksen, Jr.
8,511,251 B2 * 8/2013 Sato ..... C23C 24/04 118/308
2012/0301643 A1 * 11/2012 Aadland ..... B24C 3/02 428/34.1

FOREIGN PATENT DOCUMENTS

EP 1108903 A1 6/2001
EP 1174189 A2 1/2002
GB 921569 3/1963
GB 2347097 8/2000

OTHER PUBLICATIONS

Magni 500 Series, Magni 500 Series High-Performance Fastener/Hose Clamp Coatings, SprayTek Inc, retrieved from http://www.spraytekinc.com/documents/magni511.pdf, 2013.
International Search Report and Written Opinion of the International Search Authority in PCT/US2015/048551, dated Jan. 8, 2016.

* cited by examiner

COMBINED SPRAY AND VACUUM NOZZLE

FIELD OF THE INVENTION

The present invention relates generally to devices, systems and methods for applying thermoplastic powder to fasteners and, in particular, to a combined spray and vacuum nozzle that fits within the bore of a fastener to apply thermoplastic powder to threads within the bore.

BACKGROUND

It is known to apply thermoplastic powders to the threads of pre-heated fasteners to form a locking patch or other element that prevents the fasteners from loosening. Such a patch or element is commonly referred to as a "retention patch." The thermoplastic material is often a polyamide, but other thermoplastics or resins may be used instead.

The thermoplastic powder is typically sprayed onto the threads of a heated fastener using a spray nozzle. The spray nozzle is in communication with a source of pressurized air and thermoplastic material that is fluidized so as to spray from the nozzle. The sprayed powder that contacts the heated threads melts so as to adhere to the threads. Excess powder that does not melt and adhere to the threads is typically withdrawn from the fastener using a vacuum nozzle that communicates with a powder collection system.

It is desirable to combine the spray and vacuum functions into a single nozzle in situations where the space providing access to the threads is limited. Such is the case for internally threaded fasteners, where the fastener includes a bore containing the threads. Unitary nozzles developed for such applications include commonly assigned U.S. Pat. No. 6,454,504 to Duffy et al. and U.S. Pat. No. 6,797,320 to Sessa. The Duffy et al. '504 patent discloses a unitary nozzle where the spray and vacuum passages are concentric. The Sessa '320 patent discloses a unitary nozzle where the spray and vacuum passages are axially aligned in a stacked configuration with the spray port positioned adjacent to the vacuum port.

A need exists, however, for a unitary nozzle for applying thermoplastic powder to form a retention patch into the threads of a small closed end nut, such as a #10-32 closed end nut. The nozzle of the Sessa '320 patent, however, is not suitable for such an application because it requires that both ends of the threaded fastener bore be open and the coaxial nature of the spray and vacuum passages provide bore size constraints. The unitary nozzle of the Duffy et al. '504 patent is not suitable because the concentric orientation of the spray and vacuum passages does not allow the porting to be large enough for a sufficient amount of powder to move thru the nozzle without blocking the ports when the outside diameter of the nozzle is made small enough to enter the fastener bore with sufficient clearance.

DETAILED DESCRIPTION OF EMBODIMENTS

Figure 1:
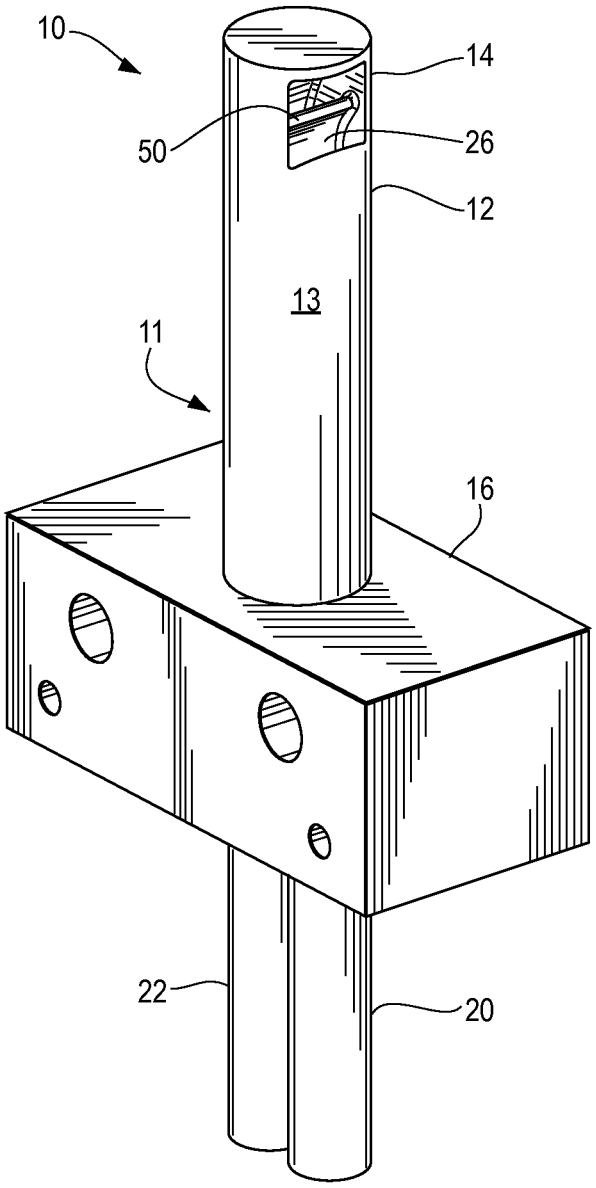
FIG. 1 is a perspective view of a nozzle assembly that includes an embodiment the combined spray and vacuum nozzle of the present invention.

A nozzle assembly including an embodiment of the combined spray and vacuum nozzle of the present invention is indicated in general at 10 in FIG. 1. The combined spray and vacuum nozzle is indicated in general at 11. The nozzle assembly includes an elongated nozzle housing 12 having a cylindrical sidewall 13 that is provided with a spray and vacuum window or opening 14 on the distal end. The nozzle housing may feature shapes other than cylindrical. The proximal end of the nozzle housing 12 is mounted to a base block 16 that is used to mount the nozzle assembly to a mechanism or machinery that raises and lowers it during use (explained in greater detail below). As examples only, and with reference to FIG. 2, the nozzle housing 12 may have a length, indicated by arrows 15, of 0.51 inches and a diameter, indicated by arrows 17, of 0.13 inches.

A powder supply conduit 20 and a vacuum withdrawal conduit 22 are also connected to the base block 16 and, as described in greater detail below, communicate with side-by-side passages within the nozzle housing. As examples only, each conduit may have an outer diameter of 0.072 inches and an inner (channel) diameter of 0.065 inches.

Figure 2:
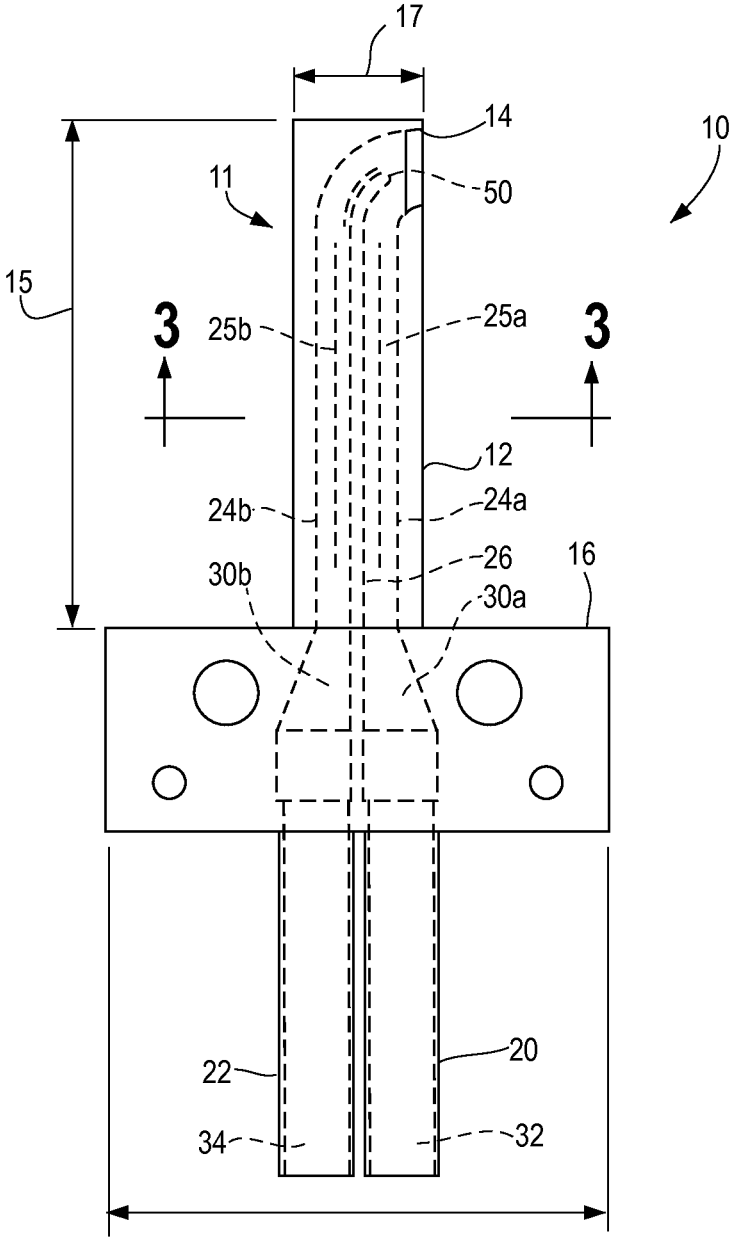
FIG. 2 is a side elevational view of the nozzle assembly of FIG. 1 with the spray and vacuum nozzle passages, passageways and channels illustrated in phantom.
Figure 3:
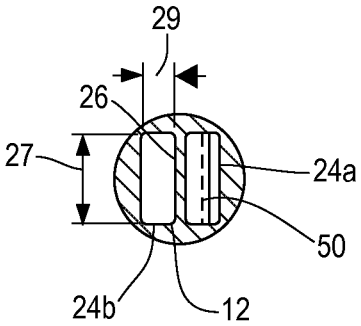
FIG. 3 is a cross sectional view of the nozzle housing of FIG. 2 taken along line 3-3 of FIG. 2.
Figure 4:
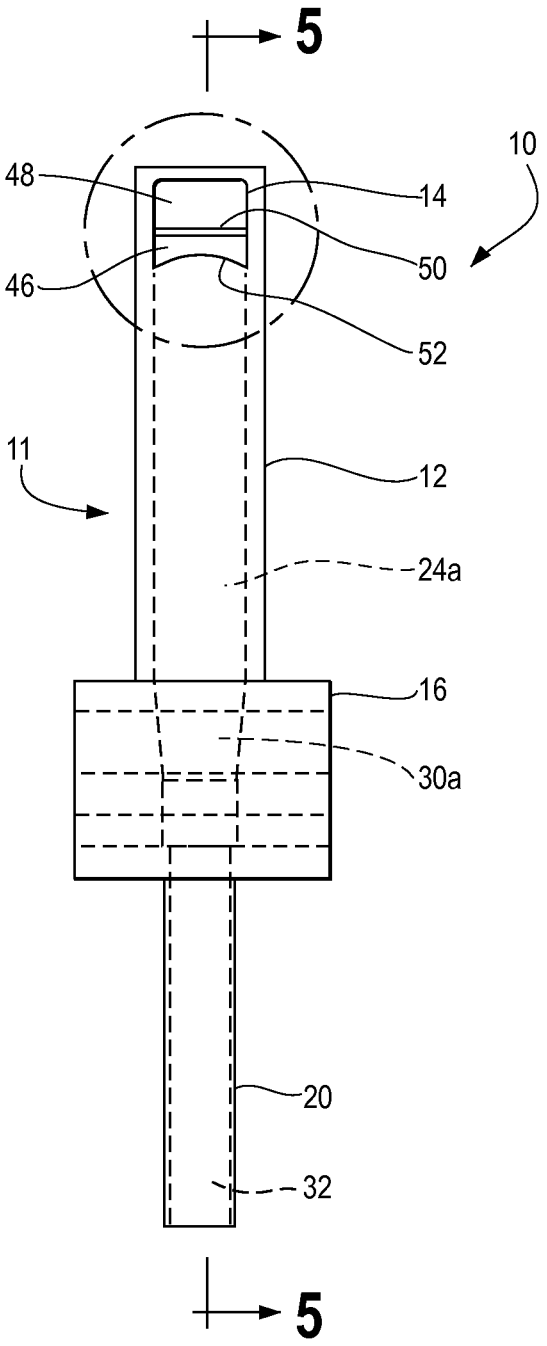
FIG. 4 is a front end elevational view of the nozzle assembly of FIG. 2.

As illustrated in FIGS. 2-4, nozzle housing 12 features passages **24*a* and 24*b*, where passage 24*a* is a powder supply passage and passage 24*b* is a vacuum withdrawal passage. In alternative embodiments, the passage types may be reversed. The passages are positioned side-by-side with the longitudinal axis of each, indicated at 25*a* and 25*b* in FIG. 2, positioned generally parallel to one another and in a spaced relationship. The passages are divided by dividing wall 26 and have curved top end portions that communicate with window 14. With reference to FIG. 3, as an example only, each passage may feature a rectangular cross-sectional shape and have a width, indicated by arrows 27, of 0.090 inches, and a depth, indicated by arrows 29**, of 0.035 inches.

Base block 16 includes a powder supply passageway **30*a* and a vacuum withdrawal passageway 30*b*. Powder supply passageway 30*a* has a top opening that communicates with the powder supply passage 24*a* of the nozzle housing 12 and a bottom opening that communicates with channel 32 of the powder supply conduit 20. Vacuum withdrawal passageway 30*b* similarly has a top opening that communicates with the vacuum withdrawal passage 24*b* of the nozzle housing 12 and a bottom opening that communicates with the channel 34 of the vacuum withdrawal conduit 22**.

When installed within machinery for use, the powder supply conduit 20 is connected to a source of aspirated thermoplastic powder and air, such as may be supplied, for example, by a venturi style powder pump. As an example only, the thermoplastic powder may be a polyamide. Of course alternative types and sources of aspirated powder and air may be used. The vacuum withdrawal conduit 22 is connected to a vacuum source and a powder collection arrangement. The vacuum source may be run continuously when the nozzle assembly is in use, or may be sequenced to operate only when the source of aspirated powder and air is activated so that powder is being supplied to the threads of a fastener by the nozzle assembly.

Figure 5:
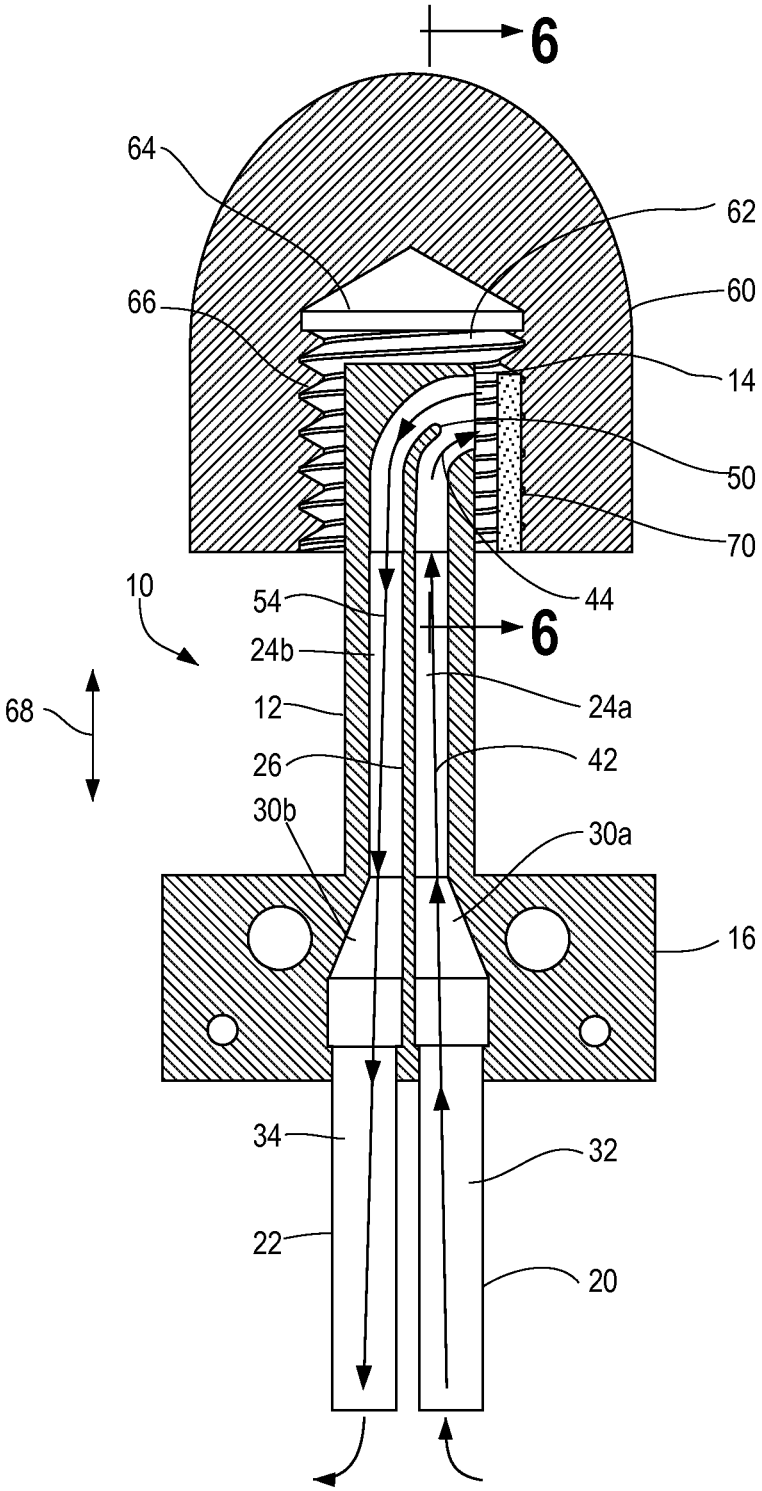
FIG. 5 is a cross sectional view of the nozzle of FIGS. 1-4 taken along line 5-5 of FIG. 4 showing the nozzle assembly being used to apply thermoplastic powder to the threads of a bore of a fastener.

As illustrated in FIG. 5, when the source of aspirated powder and air in communication with powder supply conduit 20 is activated, as indicated by arrows 42, aspirated thermoplastic powder and air travels through the channel 32 of the powder supply conduit, the powder supply passageway 30*a* of the base block 16 and the powder supply passage 24*a* of the nozzle housing 12.

The top end of the dividing wall 26 of the nozzle housing is provided with a curved distal end portion 50 (also shown in FIGS. 1-4). As illustrated by arrow 44 in FIG. 5, this directs the flow of aspirated powder and air out of the spray and vacuum window 14. As a result, the bottom side portion of widow 14 and the top edge of the curved portion 50 of the dividing wall define a spray port 46 (FIG. 4) for the nozzle assembly. As shown in FIG. 4, the bottom edge 52 of the window 14 may be provided with a generally arcuate shape to provide a more desirable powder spray profile.

As will be explained in greater detail below, powder not adhering to the heated threads of a fastener (powder overspray) is collected through a vacuum port 48 (FIG. 4) defined by the top portion of the window 14 and the top edge of the curved portion 50 of the dividing wall 26 of the nozzle housing. Due to the vacuum source connected to the withdrawal conduit 22, as indicated by arrows 54 of FIG. 5, the collected overspray powder travels through the vacuum withdrawal passage 24*b* of the nozzle housing 12, the vacuum withdrawal passageway 30*b* of the base block 16 and out through the vacuum withdrawal channel 34 of conduit 22 to a collection container or the like.

Figure 6:
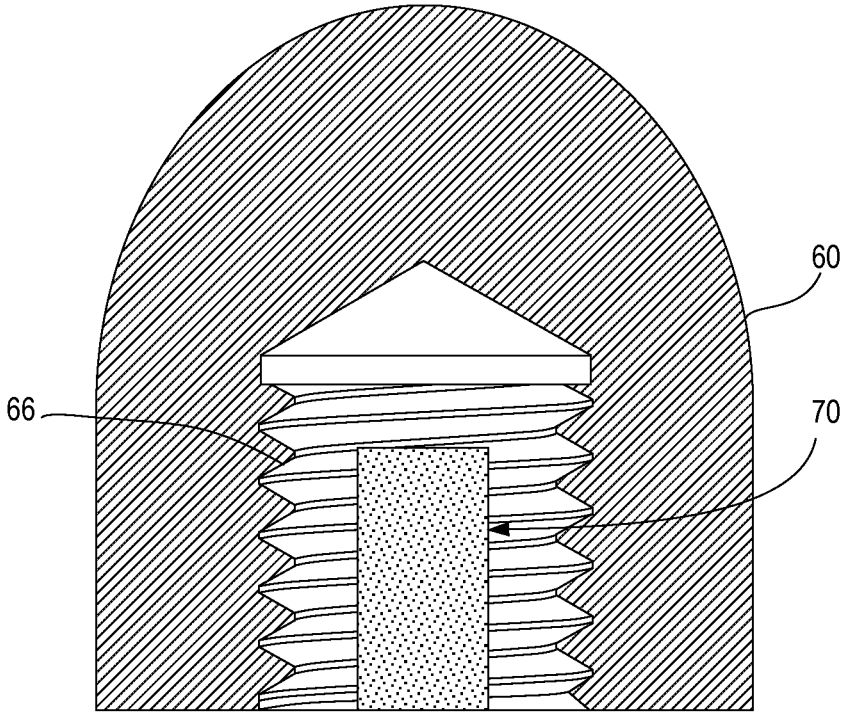
FIG. 6 is a cross sectional view of the fastener of FIG. 5 taken along line 6-6 of FIG. 5 with the nozzle housing removed illustrating the resulting retention patch.

In use, with reference to FIGS. 5 and 6, the spray nozzle assembly 10 is positioned below a fastener, such as a nut 60. The nut 60 includes a bore 62 having an open end and a closed end 64. Threads 66 are formed on the internal surface of the wall defining the bore. Of course other types of fasteners may be processed using the spray nozzle assembly.

The nut 60 is preheated and positioned above the spray nozzle assembly 10 using a system such as the ones disclosed in commonly assigned U.S. Pat. No. 5,141,771 to DiMaio et al. and U.S. Pat. No. 6,454,504 to Duffy et al., the contents of both of which are hereby incorporated by reference. Of course alternative fastener heating and handling systems known in the art may be used.

When a spray cycle is initiated, the spray nozzle assembly 10 moves upward so that the distal end of the nozzle housing 12, and thus spray and vacuum nozzle window 14, travels into the bore 62 of the nut at a controlled rate. The aspirated powder and air supply system is activated to supply an aspirated thermoplastic powder and air stream (arrows 42 and 44) to the threads 66 of the pre-heated nut so that a patch 70 of thermoplastic material is formed. As the powder exits the spray port 46 (FIG. 4) of the nozzle housing, the vacuum port 48 (FIG. 4) positioned adjacent to the powder spray port scavenges off the over-sprayed (non-melted) powder immediately after it contacts the threads. This keeps the edges of the patch 70 well defined and provides a better control of the performance of the applied patch.

The spray nozzle extends and retracts, as illustrated by arrows 68 of FIG. 5, to spray the necessary number of threads within the nut. The powder application is controlled so that the entry threads remain clean & free from any patch material. After the powder application is complete, the spray nozzle assembly 10 returns to a position below the nut.

Therefore, in the embodiment described above, a combined spray and vacuum nozzle features powder supply and vacuum withdrawal passages that reside side-by-side or bilaterally, instead of being coaxial or collinear. This construction allows for close placement of the passages. This construction also allows the passages to be large enough so that a sufficient amount of powder can move thru the system without blocking the passages. The outside diameter of the nozzle housing can also be made small enough to enter the bore of the nut with sufficient clearance. This construction provides the ability to make a patch inside a closed end internally-threaded fastener. It should also be understood that this construction method can be used on a dual open-ended fastener as well.

While the preferred embodiments of the invention have been shown and described, it will be apparent to those skilled in the art that changes and modifications may be made therein without departing from the spirit of the invention, the scope of which is defined by the appended claims.

What is claimed is:

1. A nozzle comprising:

a. a nozzle housing comprising a sidewall containing a powder supply passage and a vacuum withdrawal passage, the powder supply passage and the vacuum withdrawal passage each having a longitudinal axis, the longitudinal axes being parallel to one another substantially along an entire length of the nozzle housing and spaced from one another in a direction transverse to a length of the nozzle housing, wherein the powder supply passage and the vacuum withdrawal passage are arranged in a side-by-side relationship immediately adjacent one another substantially along an entire length of the nozzle housing, and wherein the nozzle housing further includes a dividing wall between the powder supply passage and the vacuum withdrawal passage, the dividing wall having a constant width through the nozzle housing;

b. said nozzle housing having a proximal end portion and a distal end portion, said distal end portion having a window in the sidewall and featuring a spray port in communication with the powder supply passage defined between a distal end of the dividing wall and a first portion of the window and a vacuum port in communication with the vacuum withdrawal passage defined between the distal end of the dividing wall and a second portion of the window, with the spray port positioned adjacent to the vacuum port; and c. said proximal end portion of said nozzle housing adapted to communicate with a source of aspirated powder and a vacuum source so that the powder supply passage communicates with the source of aspirated powder and the vacuum withdrawal passage communicates with the vacuum source, wherein the powder supply passage, the vacuum withdrawal passage and the dividing wall between the powder supply passage and the vacuum withdrawal passage are parallel and wherein each includes a curved top end portion through the nozzle housing, wherein the distal end of the dividing wall is disposed at a position between the proximal end portion and the distal end portion of the nozzle housing such that the powder supply passage and the vacuum withdrawal passage are in communication with one another between the distal end of the dividing wall and the distal end of the nozzle housing, and wherein the dividing wall has a length and is formed continuously along its length, and the dividing wall is connected to the sidewall and fixed against movement relative to the sidewall.

2. The nozzle of claim 1 wherein the powder supply passage and the vacuum withdrawal passage each features a rectangular cross section.

3. The nozzle of claim 2 wherein the rectangular cross sections of the powder supply passage and the vacuum withdrawal passage are the same.

4. The nozzle of claim 3 wherein the rectangular cross sections of the powder supply passage and the vacuum withdrawal passage are the same size.

5. The nozzle of claim 1 wherein the vacuum port is positioned over the spray port.

6. The nozzle of claim 1 wherein the nozzle housing is elongated and cylindrical.

7. A nozzle assembly comprising:

a. a nozzle including:

i) a nozzle housing comprising a sidewall containing a powder supply passage and a vacuum withdrawal passage, wherein the powder supply passage and the vacuum withdrawal passage are arranged in a side-by-side relationship immediately adjacent one another substantially along an entire length of the nozzle housing, the powder supply passage and the vacuum withdrawal passage each having a longitudinal axis, the longitudinal axes being parallel to one another substantially along an entire length of the nozzle housing and spaced from one another in a direction transverse to a length of the nozzle housing, the nozzle housing including a dividing wall dividing the powder supply passage and the vacuum withdrawal passage;

ii) said nozzle housing having a proximal end portion and a distal end portion, said distal end portion having a window in the sidewall and featuring a spray port in communication with the powder supply passage defined between a distal end of the dividing wall and a first portion of the window and a vacuum port in communication with the vacuum withdrawal passage defined between the distal end of the dividing wall and a second portion of the window, with the spray port positioned adjacent to the vacuum port;

b. a base block attached to the proximal end of the nozzle housing and having a powder supply passageway in communication with the powder supply passage of the nozzle housing and a vacuum withdrawal passageway in communication with the vacuum withdrawal passage of the nozzle housing, and wherein the powder supply passageway converges from an entrance to an exit and wherein the vacuum withdrawal passageway diverges from an entrance to an exit;

c. a powder supply conduit attached to the base block and in communication with the powder supply passageway of the base block and adapted to communicate with a source of aspirated powder; and d. a vacuum withdrawal conduit attached to the base block and in communication with the vacuum withdrawal passageway of the base block and adapted to communicate with a vacuum source, wherein the powder supply passage, the vacuum withdrawal passage and the dividing wall between the powder supply passage and the vacuum withdrawal passage are parallel and each includes a curved top end portion through the nozzle housing, wherein the distal end of the dividing wall and is disposed at a position between the proximal end portion and the distal end portion of the nozzle housing such that the powder supply passage and the vacuum withdrawal passage are in communication with one another between the distal end of the dividing wall and the distal end of the nozzle housing, wherein the dividing wall has a length and is formed continuously along its length, and the dividing wall is connected to the sidewall and fixed against movement relative to the sidewall.

8. The nozzle assembly of claim 7 wherein the powder supply passage and the vacuum withdrawal passage each features a rectangular cross section.

9. The nozzle assembly of claim 8 wherein the rectangular cross sections of the powder supply passage and the vacuum withdrawal passage are the same.

10. The nozzle assembly of claim 9 wherein the rectangular cross sections of each of the powder supply passage and the vacuum withdrawal passage includes a width of 0.09 inches and a depth of 0.035 inches.

11. The nozzle assembly of claim 7 wherein the vacuum port is positioned over the spray port.

12. The nozzle assembly of claim 7 wherein the nozzle housing is cylindrical.

* * * * *